US006164768A

United States Patent [19]

Murphy et al.

[11] Patent Number: 6,164,768

[45] Date of Patent: Dec. 26, 2000

[54] ADAPTER AND MATING BOTTLE CAP FOR COUPLING BOTTLES TO INK SUPPLIES

[75] Inventors: Stephen W. Murphy, Poughquag, N.Y.; Clifford J. Cahill, Sharon, Conn.

[73] Assignee: Illinois Tool Works Inc., Glenview, Ill.

[21] Appl. No.: 09/437,906

[22] Filed: Nov. 9, 1999

[51] Int. Cl.[7] ..... B41J 2/175

[52] U.S. Cl. ..... 347/85

[58] Field of Search ..... 347/84, 85, 86, 347/87; 141/367

[56] References Cited

U.S. PATENT DOCUMENTS 5,293,913 3/1994 Preszler et al. ..... 141/367
5,343,226 8/1994 Niedermeyer et al. ..... 347/85
5,903,293 5/1999 Nikkels et al. ..... 347/86
5,920,333 7/1999 Bates ..... 347/85

*Primary Examiner*—N. Le
*Assistant Examiner*—Anh T. N. Vo
*Attorney, Agent, or Firm*—Schwartz & Weinrieb

[57] ABSTRACT

An ink supply system comprises an adapter, mounted upon the ink supply reservoir, and a mating bottle cap, secured to the ink supply container, for coupling the ink supply container to the ink supply reservoir adapter, wherein both the ink supply reservoir adapter and the ink supply container cap have unique mating or corresponding polarizing structure fixedly or integrally mounted thereon such that the ink supply reservoir will only accept such uniquely predeterminedly configured or structured ink supply containers. In this manner, non-compatible or inferior quality ink materials are not introduced into the ink supply reservoir.

26 Claims, 4 Drawing Sheets

ADAPTER AND MATING BOTTLE CAP FOR COUPLING BOTTLES TO INK SUPPLIES

FIELD OF THE INVENTION

The present invention relates generally to ink supply apparatus, and more particularly to a new and improved adapter and mating bottle cap for enabling only the coupling of predeterminedly configured ink supply bottles to an ink supply reservoir within an ink jet printer system.

BACKGROUND OF THE INVENTION

A conventional PRIOR ART ink supply apparatus for supplying ink to an ink jet printer is disclosed within U.S. Pat. No. 5,343,226 which issued to Niedermeyer et al. on Aug. 30, 1994 and is disclosed within FIGS. 1 and 2 of the present patent application drawings which substantially correspond to FIGS. 10 and 11 of the aforenoted patent. More particularly, as disclosed within the aforenoted patent, it is briefly seen that the ink supply apparatus comprises a reservoir 10 which comprises a base portion 12 upon which is mounted a cover member 14. A container support portion 16 comprises an upstanding cylindrical neck member 18 having internal threads 20 for threadedly mating with a threaded cap 22 of an ink supply container 24. The threaded cap 22 includes a valve seat projection 26 upon which a spring-biased plunger valve 28 is mounted through means of a valve enclosure 29. In order to open the valve member 28 when the ink supply container 24 is mounted upon the base portion 12 of the reservoir 10, the base portion 12 is provided with an upstanding projection 30 which biases the valve member 28 upwardly against the biasing force of its spring member 32. The cover member 14 also has an upstanding portion 34 upon which a level detect mechanism 36, which includes a float member 38, is mounted for detecting the level 40 of the ink supply within the reservoir 10.

While the ink supply apparatus disclosed within the aforenoted patent obviously operates quite satisfactorily, it has been noted and realized that various different ink supply containers can be readily mounted upon the ink supply reservoir 10 in view of the fact that the ink supply containers are conventional. That is, or more particularly, any ink supply container can be simply secured upon the ink supply reservoir 10 by means of the threaded engagement defined between the externally threaded ink supply container cap 22 and the internally threaded neck portion 18 of the cover member 14 of the reservoir 10. In other words, any ink supply container 24 which is provided with an appropriate diametrically sized neck portion 42 and cap 22 and which has external threads which match the internal threads of the threaded neck portion 18 of the cover member 14 is able to be mounted and secured upon the ink supply reservoir 10. This structural arrangement or system presents significant problems, however, from a quality control viewpoint in that an ink supply container containing, for example, non-compatible ink formulations, or ink formulations which may be inferior in quality, may nevertheless be capable of being mounted upon the ink supply reservoir 10.

In order to address such a problem, or a similar problem with respect, for example, to the introduction of various ink supplies and supplies of solvent materials into an ink jet printer system, U.S. Pat. No. 5,920,333 which issued to Bates on Jul. 6, 1999 discloses a replenishment system for fluids used in connection with an ink jet printer wherein the fluid container or bottle and the mating reservoir are provided with means for ensuring that the correct container is connected to the corresponding reservoir. More particularly, as shown in FIG. 8 of the present patent application drawings, which corresponds to FIG. 4 of the Bates patent, a fluid container 10 is to be mounted upon a reservoir 26. The reservoir 26 comprises an upstanding neck portion 28 which is internally threaded, and the container 10 is provided with an externally threaded neck 16. External portions of the reservoir neck portion 28 are provided with slots 30, and a ring member 14 is adapted to be snap-fitted upon the threaded neck 16 of the container 10. The ring member 14 is provided with a pair of feet 20 which are adapted to be inserted within the slots 30 of the reservoir neck portion 28, and once inserted, the container 10 can be threadedly engaged upon the reservoir 26 due to the fact that the ring member 14 is freely rotatable upon the container 10.

While it may therefore be appreciated that the aforenoted system of Bates operates successfully in order to ensure that fluid containers are only able to be mounted upon corresponding fluid reservoirs, the system of Bates presents several operational disadvantages. Firstly, since the ring member 14 is adapted to be snap-fitted upon the container 10, and is a separate component with respect to the container 10, the ring member 14 can likewise become separated from the container 10. In addition, due to the fact that the ring member 14 is freely rotatable upon the neck portion 16 of the container 10, it is somewhat tedious to properly manipulate the container 10 and simultaneously align the feet 20 of the ring member 14 so as to be able to insert the feet 20 within the slots 30 of the reservoir neck portion 28.

A need therefore exists in the art for a new and improved ink supply system which would effectively overcome the various drawbacks and disadvantages characteristic of the PRIOR ART as set forth hereinbefore. In particular, a need exists in the art for a new and improved ink supply system wherein both the ink supply reservoir and the ink supply container cap have unique mating or corresponding structure such that the ink supply reservoir will accept only such uniquely predeterminedly configured or structured ink supply containers. Still further, a need exists in the art for a new and improved ink supply system wherein there are no separate component parts upon the reservoir or fluid container such that no separate component parts can become separated and lost, and in addition, wherein there are no relatively movable component parts rendering the mating or mounting of the fliud container upon the fluid reservoir difficult and tedious.

OBJECTS OF THE INVENTION

Accordingly, it is an object of the present invention to provide a new and improved ink supply system.

Another object of the present invention is to provide a new and improved ink supply system which is particularly useful, for example, in connection with ink supply systems for ink jet printers.

An additional object of the present invention is to provide a new and improved ink supply system which overcomes the various objections or disadvantages characteristic of the PRIOR ART ink supply systems.

A further object of the present invention is to provide a new and improved ink supply system wherein the system comprises an adapter, mounted upon the ink supply reservoir, and a mating bottle cap, secured to the ink supply container for coupling the ink supply container to the ink supply reservoir adapter, which have unique mating or corresponding structure such that the ink supply reservoir will accept only such uniquely predeterminedly configured or structured ink supply containers, and wherein the unique mating or corresponding structure is fixed upon both the reservoir adapter and the mating bottle cap.

SUMMARY OF THE INVENTION

The foregoing and other objectives are achieved in accordance with the teachings and principles of the present invention through the provision of a new and improved ink supply system which comprises an adapter, mounted upon the ink supply reservoir, and a mating bottle cap, secured to the ink supply container for coupling the ink supply container to the ink supply reservoir adapter, wherein both the ink supply reservoir adapter and the ink supply container cap have unique mating or corresponding structure such that the ink supply reservoir will accept only such uniquely predeterminedly configured or structured ink supply containers. In particular, the ink supply reservoir adapter has two substantially L-shaped notches or slots formed upon internal peripheral surface portions thereof, and the ink supply container cap has two polarizing tabs mounted upon external peripheral surface portions thereof. The ink supply container tabs are therefore adapted to be inserted into the notches or slots of the ink supply reservoir adapter, and the ink supply container is then rotated approximately one-quarter turn so as to secure the ink supply container upon the ink supply reservoir. The circumferential portions of the substantially L-shaped notches of the adapter also comprise recessed portions for receiving crush rib members of the container cap polarizing tabs whereby an operator installing a new ink supply container upon the ink supply reservoir can in effect feel or sense when the ink supply container is properly or completely installed upon the ink supply reservoir. It is particularly noted that all polarizing structure is fixed and non-movable upon the adapter and bottle cap.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts through-out the several views, and wherein.

DETAILED DESCRIPTION OF THE PREFERRED EMBODIMENT

Figure 1:
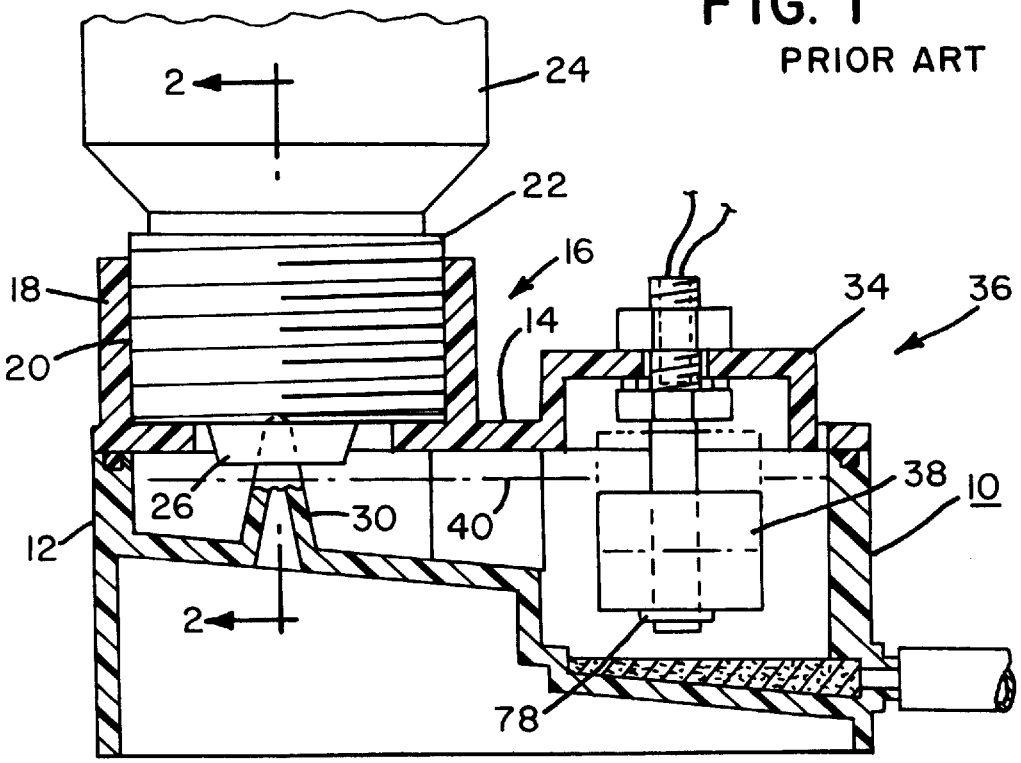
FIG. 1 PRIOR ART
FIG. 1 is a cross-sectional view of a PRIOR ART ink supply system showing a conventional ink supply container having its conventional cap portion mounted upon a conventional ink supply reservoir of the PRIOR ART ink supply system.
Figure 2:
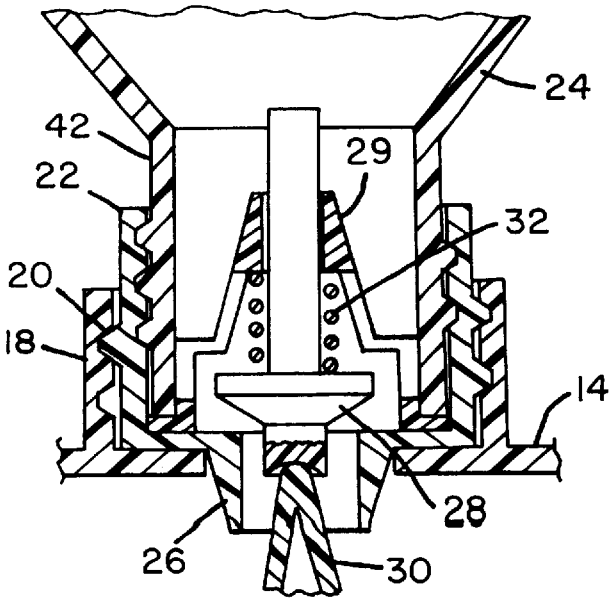
FIG. 2 PRIOR ART
FIG. 2 is a cross-sectional view of the PRIOR ART ink supply system shown in FIG. 1 as taken along the lines 2—2 of FIG. 1.
Figure 3:
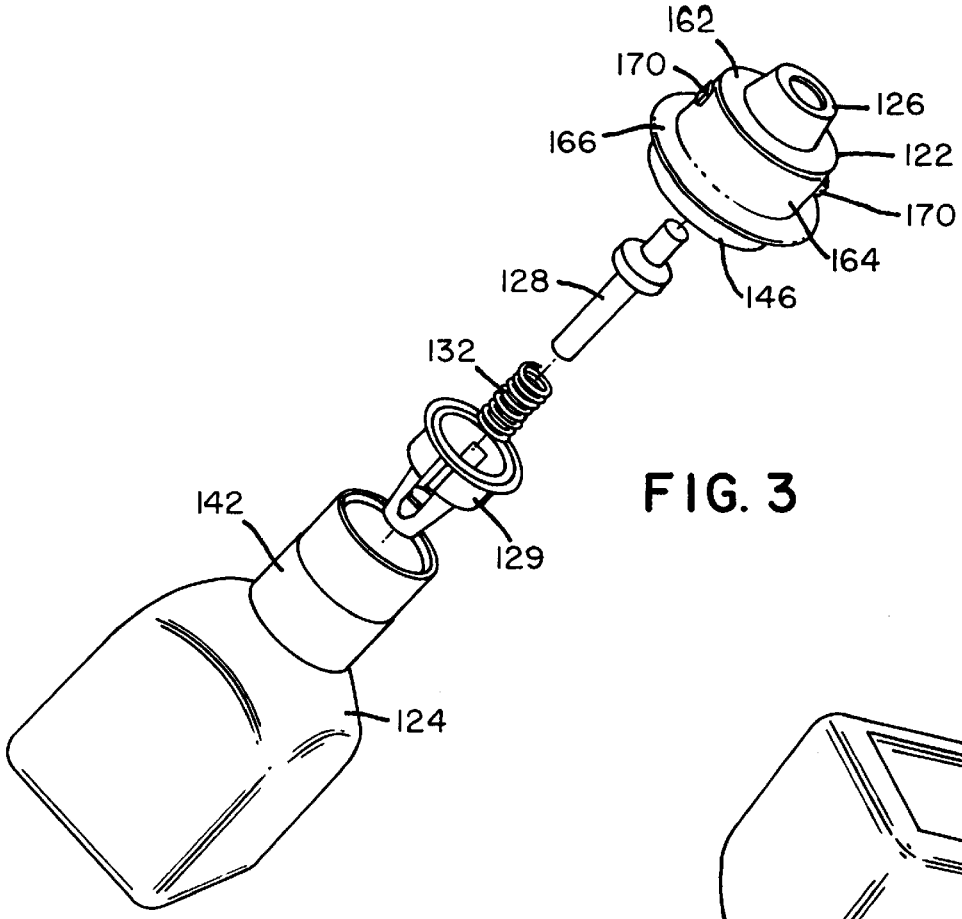
FIG. 3 is an exploded perspective view of a new and improved ink supply container or bottle which comprises a new and improved bottle cap which is constructed in accordance with the principles and teachings of the present invention so as to have unique polarizing tab structure integrally formed thereon and which is adapted to be mounted upon the new and improved ink supply container or bottle.
Figure 4:
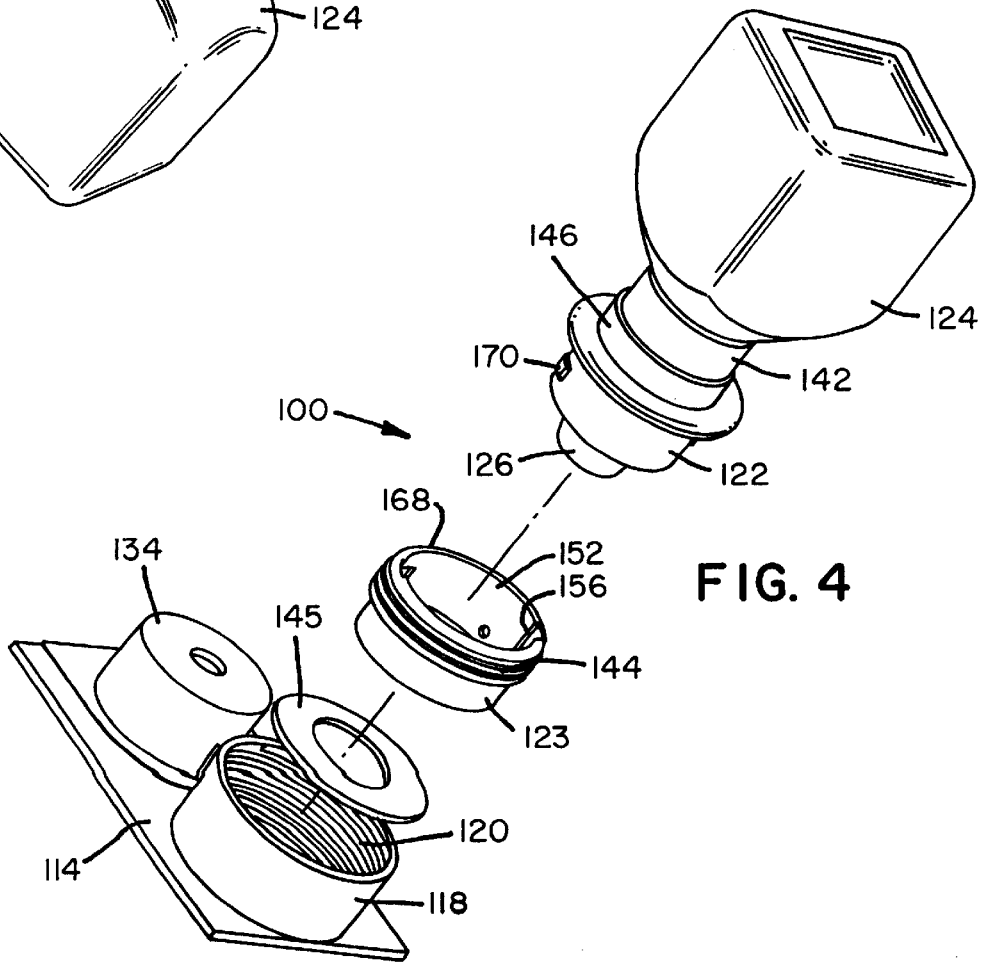
FIG. 4 is an exploded perspective view of a new and improved ink supply reservoir cover member and a new and improved bottle cap adapter which is adapted to be mounted upon the ink supply reservoir cover member for mating with the new and improved container or bottle cap portion of the new and improved ink supply container or bottle shown in FIG. 3 and which is constructed in accordance with the principles and teachings of the present invention so as to also have integral polarizing structure thereon for receiving and mating with the corresponding polarizing structure of the new and improved bottle cap of the new and improved ink supply container or bottle as illustrated in FIG. 3.

Referring now to the drawings, and more particularly to FIGS. 3 and 4 thereof, the new and improved ink supply container or bottle adapter and ink supply container or bottle system constructed in accordance with the principles and teachings of the present invention is disclosed and is generally indicated by the reference character 100. For ease of understanding of the present invention and its correlation with the PRIOR ART system as disclosed within FIGS. 1 and 2, it is noted that component parts of the present invention system 100 which correspond to those similar component parts of the PRIOR ART system disclosed within FIGS. 1 and 2 of the drawings will be indicated by similar reference characters except that the reference characters designating the parts of the present invention system will be within the 100 series. More particularly, the ink supply system 100 is seen to comprise an ink supply reservoir cover member 114 upon which is mounted an upstanding cylindrical neck member 118, for mounting an ink supply bottle or container 124 thereon, and an upstanding housing portion 134, for enclosing an ink supply level detect mechanism, not shown.

The internal periphery of the upstanding neck member 118 is provided with threads 120, and a new and unique ink supply reservoir adapter 123 has threads 144 disposed upon the upper outer peripheral surface portion thereof. A shipping gasket 145 is adapted to be inserted within upstanding neck member 118 of the ink supply reservoir cover member 114, and the ink supply reservoir adapter 123 is adapted to be inserted into the upstanding neck member 118 of the ink supply reservoir cover member 114 as a result of the threaded engagement of the external threads 144 of the adapter 123 with the internal threads 120 of the upstanding neck member 118 of the ink supply reservoir cover member 114. After threaded engagement of the adapter 123 within the upstanding neck member 118 of the ink supply reservoir cover member 114 is completed, the adapter 123 can be permanently disposed and retained within the upstanding neck member 118 of the ink supply reservoir cover member 114 by means of a suitable epoxy or the like which has been previously applied to either one or both of the threaded portions 120,144 of the upstanding neck member 118 of the ink supply reservoir cover member 114 and the adapter 123, respectively. It is thus to be appreciated that in accordance with the principles and teachings of the present invention, and as will become more fully apparent hereinafter, the ink supply system 100 of the present invention, as considered in connection with or with respect to the aforenoted PRIOR ART systems, comprises an additional component, that is, the adapter 123, for interfacing with the upstanding neck member 118 of the ink supply reservoir cover member 114 and for thereby enabling mounting of the ink supply container or bottle 124 upon or within the upstanding neck portion 118 of the ink supply reservoir cover member 114 so as to in turn supply ink to the ink supply reservoir, not shown.

As best seen in FIG. 3, the new and improved ink supply container or bottle 124 has a neck portion 142, and internally within the ink supply container or bottle 124 there is disposed a valve enclosure 129 and a plunger valve member 128. An ink supply container or bottle cap 122 has a forwardly extending or downwardly projecting portion 126 which has an internal portion which effectively forms a valve seat for the valve member 128. The valve member 128 is biased toward the valve seat formed upon the downwardly projecting portion 126 of the ink supply container or bottle cap 122 by means of a coil spring 132. A rearwardly extending portion 146 of the ink supply container or bottle cap 122 is adapted to be mated with the neck portion 142 of the ink supply container or bottle 124, and the ink supply container or bottle and ink supply container or bottle cap assembly is then mated together and rendered permanently integral by means of, for example, spin welding techniques.

Figure 5:
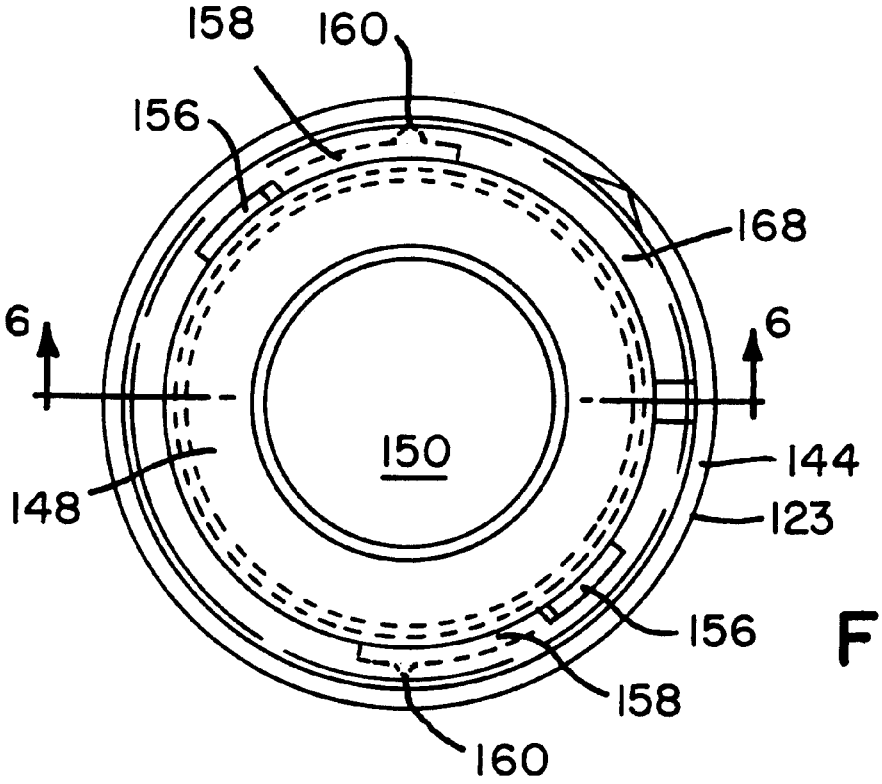
FIG. 5 is a top plan view of the new and improved bottle caper as illustrated in FIG. 4.
Figure 6:
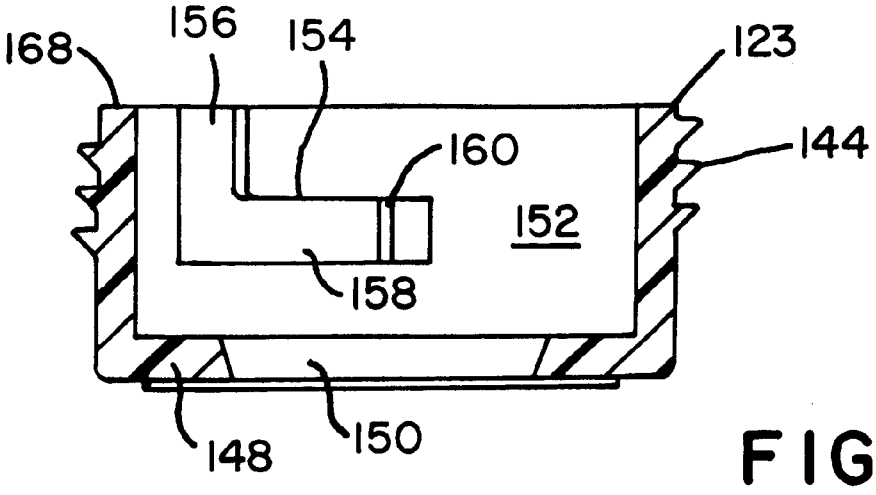
FIG. 6 is a cross-sectional view of the new and improved bottle adapter as shown in FIG. 5 and as taken along the lines 6—6 of FIG. 5 so as to particularly illustrate the substantially L-shaped polarizing notch or slot structure of the adapter as well as the recessed portion of such notch or slot structure for accommodating the crush rib structure of the new and improved bottle cap of the present invention.

With reference now being additionally made to FIGS. 5 and 6, the new and improved adapter 123, constructed in accordance with the principles and teachings of the present invention, is seen to comprise a substantially cupshaped housing or member having a bottom wall 148 with a central aperture or opening 150 defined therethrough for receiving the projecting portion 126 of the ink supply container or bottle cap 122 and for permitting the projecting portion 126 of the ink supply container or bottle cap 122 to extend therethrough. An upstanding peripheral side wall 152 is integrally connected to the outer periphery of the bottom wall 148, and the internal surface of the upstanding peripheral side wall 152 is provided with a pair of diametrically opposed substantially L-shaped polarizing slots 154 each one of which comprises an axially extending leg portion 156 and a circumferentially extending leg portion 158. In addition, the circumferentially extending leg portion 158 is provided with a radially outwardly extending concave or recessed portion 160 for a purpose to be discussed shortly hereinafter.

Figure 7:
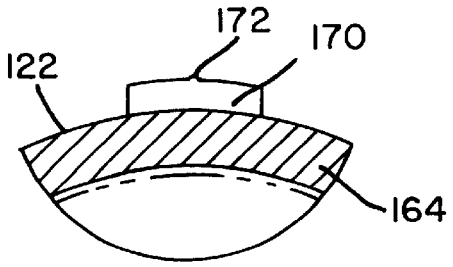
FIG. 7 is a partial cross-sectional view of an outer peripheral side wall portion of the new and improved bottle cap as shown in FIG. 3 and particularly showing the polarizing tab and crush rib structure of the bottle cap for disposition within the notch or slot structure, and the recessed portion thereof, of the bottle cap adapter as shown in FIG. 6.
Figure 8:
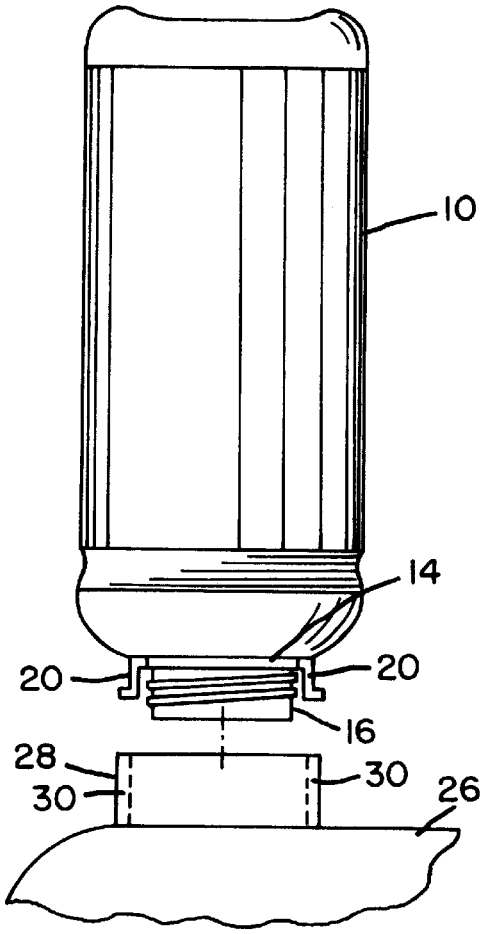
FIG. 8 PRIOR ART
FIG. 8 is a partial front elevational view of an ink jet reservoir and supply container system showing a PRIOR ART fluid container and reservoir alignment system.

With reference now being made to FIG. 7 in conjunction with FIGS. 3 and 4, it is further appreciated that the new and improved ink supply container or bottle cap 122, in a manner similar to or corresponding with the adapter 123, comprises a substantially cup-shaped member which also has a bottom wall or lower flanged portion 162 as considered from the viewpoint of when the ink supply container or bottle 124 is disposed in its normal or operative inverted state such as when the same is mounted upon the ink supply reservoir cover member 114. The inner periphery of the bottom wall or lower flanged portion 162 of the ink supply container or bottle cap 122 is integral with the downwardly projecting portion 126, and the outer periphery of the bottom wall or lower flanged portion 162 is integral with the lower axial end of an upstanding or upwardly projecting side wall 164. The upper axial end of the upstanding or upwardly projecting side wall 164 is integral with a second upper flanged portion 166.

Consequently, it can be readily appreciated that when the ink supply container or bottle 124 is mounted upon the ink supply reservoir cover member 114, and more particularly, when the ink supply container or bottle cap 122 is mated with the ink supply reservoir adapter 123 fixedly mounted within the upstanding neck member 118 of the ink supply reservoir cover member 114, the bottom wall or lower flanged portion 162 of the ink supply container or bottle cap 122 will be seated upon the bottom wall portion 148 of the adapter 123, the downwardly projecting portion 126 of the ink supply reservoir container or bottle cap 122 will project downwardly through the central aperture or opening 150 of the ink supply reservoir adapter 123, the peripheral side wall 164 of the ink supply container or bottle cap 122 will be disposed internally within the peripheral side wall 152 of the ink supply reservoir adapter 123, and the upper flanged portion 166 of the ink supply container or bottle cap 122 will be seated upon the upper peripheral edge portion 168 of the ink supply reservoir adapter 123.

As was the case with the ink supply reservoir adapter 123, in accordance with the principles and teachings of the present invention and with reference still being made to FIGS. 3,4, and 7, the peripheral side wall 164 of the ink supply container or bottle cap 122 is also integrally provided with a pair of diametrically opposed polarizing tabs 170. These polarizing tabs 170 are adapted to be inserted within the L-shaped slots or notches 154 of the ink supply reservoir adapter 123, and accordingly, such polarizing tabs 170 are therefore seen to serve several purposes. Firstly, the polarizing tabs 170 serve as a means for lockingly engaging or mounting the ink supply container or bottle 124 upon the ink supply reservoir cover 114 through means of the ink supply reservoir adapter 123. When the ink supply container or bottle 124 is being mounted upon the ink supply reservoir adapter 123, the polarizing tabs 170 will be initially disposed within the axially extending legs 156 of the adapter slots or notches 154, and when the polarizing tabs 170 then bottom out within the axially extending legs 156, the ink supply container or bottle 124 may then be rotated approximately one-quarter turn so as to move the polarizing tabs 170 within the circumferentially extending legs 158 of the adapter slots or notches 154 thereby locking the ink supply container or bottle 124 upon the ink supply reservoir adapter 123 in a bayonet-type manner.

As best seen in FIG. 7, each one of the polarizing tabs 170 also comprises a convexly shaped or radially outwardly projecting rib 172 at its central portion for engaging the recessed portion 160 formed within the circumferentially extending leg portions 158 of the slots or notches 154 of the ink supply reservoir adapter 123. In this manner, when the ink supply container or bottle 124 is rotated through means of its quarter-turn movement, and when the ink supply container or bottle 124 has been fully rotated with respect to the fluid reservoir and reservoir adapter 123, the projecting rib 172 of each polarizing tab 170 will in effect snap fit into the recessed portion 160 of each circumferentially extending leg portion 158 of each slot or notch 154 so as to convey to the operator or maintenance personnel that the ink supply container or bottle 124 has been properly and fully mounted upon the ink supply reservoir cover member 114. The newly mounted ink supply container or bottle 124 is then ready to dispense ink into the ink supply reservoir.

A second purpose for the provision of the polarizing tabs 170 upon the ink supply container or bottle cap 122 in accordance with the unique principles and teachings of the present invention resides in the fact that only those ink supply containers or bottles 124 provided with such polarizing tabs 170 can in fact be mounted upon the ink supply reservoir cover member 114 as a result of the polarized slot or notch structure 154 of the ink supply reservoir adapter 123. Accordingly, such intercooperative ink supply container or bottle cap and reservoir adapter structure ensures the fact that only predetermined or particular ink supply containers or bottles 124, containing, for example, ink supplies of predetermined quality, or ink supplies which are compatible with the ink jet apparatus in connection with which they are being used, can in fact be mounted upon the ink supply reservoir.

Thus, it may be seen that in accordance with the teachings and principles of the present invention, there has been provided a new and improved ink supply reservoir cover member adapter which is especially structured or configured so as to only mate with a similarly or correspondingly configured or structure ink supply container or bottle cap. In this manner, only those ink supply containers or bottles having the particularly structured or configured bottle cap can be mounted upon the ink supply reservoir thereby ensuring that only compatible ink materials, or ink materials of predetermined quality, can be supplied into the ink supply reservoir and the ink jet printing system. It is also possible to retrofit existing ink supply reservoirs with the system of the present invention in that in lieu of the ink supply container or bottle cap being threadedly engaged within the upstanding internally threaded neck portion of the ink supply cover member as is the case of the PRIOR ART system shown in FIGS. 1 and 2, the uniquely structured ink supply reservoir cover adapter of the present invention can be threadedly engaged and subsequently affixed therein, and subsequently, the ink supply containers or botles having the uniquely structured container or bottle caps can be mounted upon the ink supply reservoir adapter. It is lastly to be noted that in accordance with the teachings and principles of the present invention, the polarizing structure of both the ink supply reservoir adapter and the ink supply container or bottle are integral with their respective components such that none of the components can become separated or lost, and the mating or polarizing alignment process is rendered simple so as to be readily performed.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. An adapter for interfacing with an ink supply reservoir and an ink supply container so as to permit an ink supply container to be mounted upon an ink supply reservoir, comprising:

a housing member having an upstanding peripheral side wall;

means defined upon said housing member for permitting said adapter to be removably mounted upon the ink supply reservoir; and first polarizing means defined upon an interior portion of said upstanding peripheral side wall of said housing member for mating with second polarizing means disposed upon an exterior peripheral side wall of a container cap which is fixedly mounted upon the ink supply container so as to permit said adapter to be mated only with an ink supply container having the second polarizing means disposed thereon, whereby only a particular ink supply container is able to be mounted upon the ink supply reservoir.

2. The adapter as set forth in claim 1, wherein:

said housing member has a substantially cup-shaped configuration which further comprises a bottom wall.

3. The adapter as set forth in claim 1, wherein:

said means defined upon said housing member for permitting said housing member to be removably mounted upon the ink supply reservoir comprises thread means defined upon an external peripheral surface of said substantially upstanding peripheral side wall.

4. The adapter as set forth in claim 1, wherein:

said first polarizing means comprises substantially L-shaped slot means for receiving the second polarizing means of the ink supply container.

5. The adapter as set forth in claim 4, further comprising:

concave recessed means defined within said upstanding peripheral side wall of said housing member for receiving a convex rib of the ink supply container so as to convey to operator and maintenance personnel the fact that the ink supply container is properly mounted upon the ink supply reservoir.

6. The adapter as set forth in claim 4, wherein:

said substantially L-shaped slot means defines a bayonet-type connection between said adapter and the ink supply container.

7. The adapter as set forth in claim 1, further comprising:

bonding means disposed upon said adapter for fixedly retaining said adapter mounted within the ink supply reservoir.

8. An ink supply container to be mounted upon an ink supply reservoir, comprising:

an ink supply bottle;

a bottle cap fixedly mounted upon said ink supply bottle; and first polarizing means integrally disposed upon an exterior peripheral side wall of said bottle cap for mating with second polarizing means disposed upon an interior peripheral side wall portion of the ink supply reservoir so as to permit said ink supply bottle to be mated only with an ink supply reservoir having the second polarizing means disposed thereon, whereby only a particular ink supply bottler is able to be mounted upon the ink supply reservoir.

9. The ink supply container as set forth in claim 8, wherein:

said first polarizing means comprises polarizing tabs disposed upon said exterior peripheral side wall for mating with the second polarizing means of the ink supply reservoir.

10. The ink supply container as set forth in claim 9, further comprising:

convex rib means defined upon said polarizing tabs for insertion within a corresponding concave recess of the ink supply reservoir so as to convey to operator and maintenance personnel the fact that the ink supply container is properly mounted upon the ink supply reservoir.

11. An ink supply system for permitting an ink supply container to be mounted upon an ink supply reservoir, comprising:

an ink supply reservoir cover for covering said ink supply reservoir;

an adapter comprising a housing member having an upstanding peripheral side wall;

said ink supply container comprising a cap member;

means defined upon said adapter housing member for permitting said adapter to be fixedly mounted upon said ink supply reservoir cover;

first polarizing means defined upon an interior portion of said upstanding peripheral side wall of said adapter housing member; and second polarizing means, corresponding to said first polarizing means of said adapter housing member, integrally disposed upon an exterior side wall portion of said cap member of said ink supply container for mating with said first polarizing means of said adapter housing member and thereby permitting said ink supply reservoir to be mated only with said ink supply container having said second corresponding polarizing means thereon, whereby only a particular ink supply container is able to be mounted upon said ink supply reservoir.

12. The system as set forth in claim 11, wherein:

said adapter housing member has a substantially cup-shaped configuration which further comprises a bottom wall.

13. The system as set forth in claim 11, further comprising:

thread means defined upon an external peripheral surface of said upstanding peripheral side wall of said adapter housing member for permitting said adapter housing member to be removably mounted upon said ink supply reservoir.

14. The system as set forth in claim 11, further comprising:

bonding means disposed upon said adapter housing member for fixedly retaining said adapter housing member mounted within said ink supply reservoir.

15. The system as set forth is claim 11, wherein:

said first polarizing means comprises substantially L-shaped slot means for receiving said corresponding second polarizing means of said ink supply container.

16. The system as set forth in claim 15, wherein:

said second polarizing means comprise polarizing tabs integrally disposed upon said peripheral side wall of said cap member for mating with said first substantially L-shaped polarizing slots of said adapter housing member.

17. The system as set forth in claim 16, further comprising:

convex rib means defined upon said polarizing tabs of said cap member of said ink supply container; and concave recess means defined upon said peripheral side wall of said adapter housing member for receiving said convex rib means of said polarizing tabs of said cap member so as to convey to operator and maintenance personnel the fact that said ink supply container is properly mounted upon said ink supply reservoir.

18. The system as set forth in claim 16, wherein:

said substantially L-shaped slot means of said adapter housing member and said polarizing tabs of said cap member together define a bayonet-type connection between said adapter housing member and said ink supply container.

19. An ink supply system for an ink jet printer so as to permit only particular ink supply containers to be mounted upon the ink jet printer ink supply reservoir, comprising:

an ink supply reservoir cover for covering an ink supply reservoir;

an adapter comprising a housing member having an upstanding peripheral side wall;

an ink supply container comprising a cap member;

means defined upon said adapter housing member for permitting said adapter to be fixedly mounted upon said ink supply reservoir cover;

first polarizing means defined upon an interior portion of said upstanding peripheral side wall of said adapter housing member; and second polarizing means, corresponding to said first polarizing means of said adapter housing member, integrally disposed upon an exterior side wall portion of said cap member of said ink supply container for mating with said first polarizing means of said adapter housing member and thereby permitting said ink supply reservoir to be mated only with said ink supply container having said second corresponding polarizing means thereon, whereby only a particular ink supply container is able to be mounted upon said ink supply reservoir.

20. The system as set forth in claim 19, wherein:

said adapter housing member has a substantially cup-shaped configuration which further comprises a bottom wall.

21. The system as set forth in claim 19, further comprising:

bonding means disposed upon said adapter housing member for fixedly retaining said adapter housing member mounted within said ink supply reservoir.

22. The system as set forth in claim 19, further comprising:

thread means defined upon an external peripheral surface of said upstanding peripheral side wall of said adapter housing member for permitting said adapter housing member to be removably mounted upon said ink supply reservoir.

23. The system as set forth in claim 21, wherein:

said first polarizing means comprises substantially L-shaped slot means for receiving said corresponding second polarizing means of said ink supply container.

24. The system as set forth in claim 23, wherein:

said second polarizing means comprise polarizing tabs integrally disposed upon said peripheral side wall of said cap member for mating with said first substantially L-shaped polarizing slots of said adapter housing member.

25. The system as set forth in claim 24, further comprising:

convex rib means defined upon said polarizing tabs of said cap member of said ink supply container; and concave recess means defined upon said peripheral side wall of said adapter housing member for receiving said convex rib means of said polarizing tabs of said cap member so as to convey to operator and maintenance personnel the fact that said ink supply container is properly mounted upon said ink supply reservoir.

26. The system as set forth in claim 24, wherein:

said substantially L-shaped slot means of said adapter housing member and said polarizing tabs of said cap member together define a bayonet-type connection between said adapter housing member and said ink supply container.

* * * * *